United States Patent [19]

Gabbard

[11] Patent Number: 4,768,701

[45] Date of Patent: Sep. 6, 1988

[54] MULTIDIMENSIONAL DECORATIVE ELEMENT

[76] Inventor: Elbert S. Gabbard, P.O. Box 415, Oconomowoc, Wis. 53066

[21] Appl. No.: 28,906

[22] Filed: Mar. 23, 1987

[51] Int. Cl.[4] ..... B65D 1/00

[52] U.S. Cl. ..... 229/8; 229/41 C; 229/114; 229/108

[58] Field of Search ..... 229/8, 41 C, 105, 108, 229/110, 111, 112, 113, 114, 117

[56] References Cited

U.S. PATENT DOCUMENTS 1,950,111 3/1934 Heim ..... 229/114

4,418,497 12/1983 Mastriano ..... 229/8

*Primary Examiner*—Willis Little

*Attorney, Agent, or Firm*—Robert J. Black

[57] ABSTRACT

A decorative element typically constructed of paperboard coated with metallic foil and including a base of geometric form and a number of side panels extending away from the base at an angle so that a reflection of the base is apparent on the side panels and/or the reverse. Any designs incorporated on the base or side panels are also reflected providing a pleasing overall effect.

34 Claims, 3 Drawing Sheets

MULTIDIMENSIONAL DECORATIVE ELEMENT

BACKGROUND OF THE INVENTION

1. Field of the Invention

This invention relates to decorative elements and more particularly, to a multidimensional decorative element that effectively combines dimensional panels in a plurality of planes, a portion of which may include reflective surfaces and a portion of which may include graphic decorations in such a manner as to provide pleasing decorative elements which can incorporate visual three-dimensional effects. The element, as shown, can be combined with containers, boxes, decorative panels, etc., as well as used as an ornament only.

2. Description of Related Art

The present invention relates to structural graphic pieces and to some extent bears relationship to ornaments, greeting cards, pop-up books and other folded brochures which can be made available in a flat format which may be useful for mailing and then upon receipt, may be fashioned into a three-dimensional ornament or display device. Such displays, which are sometimes known as pop-up displays, have been available and have been used in greeting cards and popup books. Displays of this type are found in U.S. Pat. Nos. 2,770,407, 2,883,074 and 3,571,958.

At least one structural graphic piece is known to include reflective surfaces on a portion thereof to achieve a desired visual effect. Such an arrangement is taught in U.S. Pat. No. 3,834,051. The principal purpose, however, of the teachings of this patent is to provide a structural graphic piece in which an anamorphic representation of some desired item becomes visible and intelligible by opening the piece. In one particular embodiment of the invention, there is provided a greeting card or similar brochure which includes a plurality of flaps hingedly interconnected along fold lines and movable between a closed folded position and an open position.

None of the art, as shown in the referenced patents, suggests the object of the present invention, which is to provide a multidimensional decorative element in which reflective surfaces and graphic decorations included on planar portions of the invention are combined in such a way as to provide a three-dimensional or other pleasing visual concept.

SUMMARY OF THE INVENTION

The present invention consists of a multidimensional decorative element that includes a first planar base panel, with that base panel having at least three sides and both upper and lower surfaces. From the sides of the base panel there extend a plurality of planar side panels. If, for example, there are three sides to the base panel, then there would be three side panels and if there are four sides to the base panel, then there will be four side panels etc. Each of the side panels extends angularly away from the base panel, with each side panel, including a first and second surface and, in addition to the side adjacent to the base panel, at least two other sides with each side panel being adjacent to one of the other side panels. Thus, if the base panel is triangular in form, the three side panels angled up from that base form a triangular-shaped wall around the base panel. If the base panel is square, obviously, the four side panels would then be employed to form a square-shaped wall around the base panel. Generally, the angle of the side panels is up and out or away from the base panel so that the encompassed area enlarges from the base panel to the upper portion defined by the side panels forming an effective wall around the base panel.

In at least one form of the present invention, the decorative element claimed has a base panel that includes the upper or first surface being light reflective. In other forms, one or more of the side panels (on that portion of the panel that faces inward towards the base panel) may include a light reflective coating. Additionally, graphic designs may be present on either one or both of the base and/or side panels.

This utilization of reflective surfaces and/or graphic images assists in providing a constantly changing reflected three-dimensional visual image with movement seen within the reflected image. Changes and movement within the reflected three-dimensional visual image result from any change of position of the viewer's eye in relation to the position of the reflected image.

An enhancement of the movement within the three dimensional reflected visual image may be achieved by printing or decorating selected areas of the reflective surfaces with opaque inks or other coloring material. This results in the disappearance of all or part of the portions of the reflected image as it passes through the opaque areas on the reflective surfaces. Furthermore, a change of color or colors within the reflected image may be achieved by printing selected areas of the reflective surfaces with transparent inks or other colored media. For example, a transparent yellow ink area on the reflective surface will change the color of a reflected blue image to that of a reflected green image.

In the present invention, the utilization of multiple planes in the element creates the visual three-dimensional effect of a new shape receding into the display. Thus, effectively, a two-dimensional printed image is transformed into the three-dimensional shape by adding sides to it. The image in two dimensions on the flat base surface is reflected by the side panels. Thus, the number of sides included will determine the new shape which, of course, varies with the number of reflective planes that intersect with the two-dimensional plane of the base panel on which the image is located.

Several types of construction can be utilized in practicing the presentinvention. For example, a glued tube construction employing foil-laminated paperboard may be utilized. A wide range of materials may be used for the reflective-laminate surface. One of these might well be metalized polyester. In such an arrangement, scored flaps from the open end of the glued tube can be folded in and locked together, after which a printed die-cut and scored paperboard insert with flanges could be inserted through the open end of the formed glued tube butting against the bottom edges of the formed reflective flaps. In another arrangement, a one-piece type of construction can be employed for the base panel and the side panels, where, by means of gluing or by the use of tabs and slots, a single flat one-piece unit die-cut and foldable can be assembled either as a single ornament or incorporated into a folding carton type of construction.

In any of the suggested forms of construction, different three-dimensional reflective visual images may be achieved by varying the angle degree of the reflective surface flaps in relation to the flat base surface that the side panels will reflect.

If glued tube construction is utilized, the in-folding reflective flaps can be incorporated on both ends of the glued tube, if the construction is to be for an ornament or display, or perhaps only on one end if it is to be used as an ornamental gift box. Obviously, any of the well-known techniques of carton- closure styles may be used on the end opposing the decorative ornament end. It will be obvious from the foregoing that other variations, of course, are also possible in construction. The reflectiveness of a concealed image can also effectively be utilized.

In addition to ornaments such as may be utilized for hanging on Christmas trees or for similar decorative purposes, other utilization of the decorative element of the present invention might include window displays, counter displays, floor displays, mobiles. Aesthetic architectural embellishments, such as panels and elevator ceilings, walls or display counters could also be utilized. These might be arranged so that they are interchangeable with snap-in image inserts utilized for different seasonal designs, holidays, etc. Such panels could be utilized for ceiling panels, wall panels, mobiles for entrance areas in lobbies of buildings, with such design elements being incorporated into the permanent logo or name, trademark, etc. identification utilized by corporations in connection with their products on their buildings, offices, etc.

Other possible utilization of the present decorative elements might be their inclusion into outdoor billboard type of advertising to offer both movement and a changing display through the movement of the visual observers as they pass by the outdoor advertising signs. Still other uses might include advertising novelties for desks, such as paperweights and calendars, as well as, as mentioned previously, in logo identification associated with radios, refrigerators, automobile hubcaps, etc. From the foregoing wide variety of applications of the present invention, it will be obvious that materials other than paperboard, such as wood, glass, metal, plastics and virtually any formable material could be utilized. Certainly extensive markets exist for the utilization of the present invention in a broad scope of consumer and industrial usage.

DESCRIPTION OF THE PREFERRED EMBODIMENTS

Figure 1:
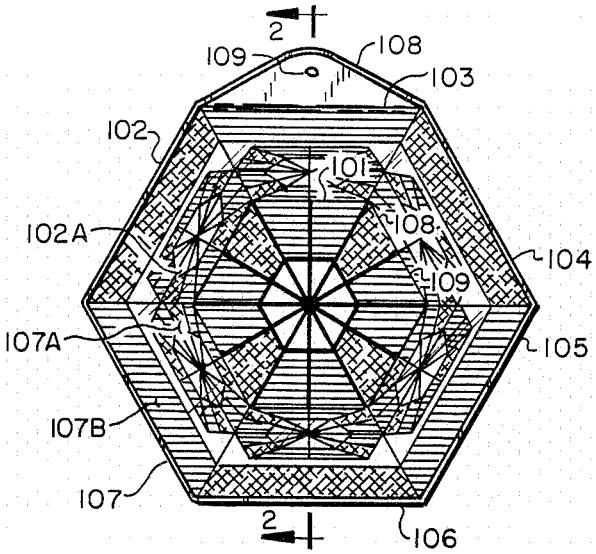
FIG. 1 is a front-view of a hexagonal multidimentional decorative element in accordance with the present invention.

Referring now to FIG. 1, a multidimensional decorative element in accordance with the present invention is shown in hexagonal form. It should be understood that virtually any geometric form employing three or more angles in its base configuration can be employed in the present invention. For example, triangles, squares, pentagons, octagons, etc. can be utilized in addition to the hexagonal form shown. The decorative element consists of a flat planar panel 101 which is hexagonal in form. As shown in FIG. 1, panel 101 includes a graphic design thereon consisting of a number of triangular-shaped panels; some like 108 may be colored with ink or paint of a first color, while those shown as 109 with a differnt color of paint or ink. Such coloring may be opaque, translucent or transparent depending upon the decorative design and the effect desired. The base coating of element 101, which may be of paper or other material construction, may or may not be covered depending upon the decorative requirements with a reflective surface such as may be available in foil-laminated papers. Such foil may be of metallic polyester composition or similar.

Surrounding the base panel 101 are six panels 102, 103, 104, 105, 106 and 107. Each of these panels at one edge thereof join to the base panel 101 and each of the panels 102 through 107 inclusive abut and join two other adjacent panels. Each of these panels, as may be seen by reference to FIG. 2, extend up and away from on an angular basis from panel 101. Again, each of the panels 102 through 107 inclusive may or may not, depending upon the decorative impact desired, consist of a foil-coated or metallic-coated laminated product such as paper, plastic, etc. Each panel may also include one or more graphic designs thereon which have been shown, for example, in FIG. 1 as a colored portion 107B in panel 107A and in similar form on all of the other panels. Again, the panels that bear the decorative motif may take many different forms and be of different colors and incorporate both opaque, transparent and/or translucent coloring media. If, as shown in FIG. 1, the panels 102 through 107 inclusive all include a reflective surface, then any graphic pattern present on planar panel 101 will be reflected in a slightly different form on the side panel because of the angular relationship. This can readily be seen by reference to panel 102, wherein the reflected image 102A, is specifically identified. Such reflection would also appear on all the other panels but has not been shown for purposes of clarity in FIG. 1.

Also shown in FIG. 1 and attached to the panel 103 is a panel extension 108 which includes an opening therein 109 through which a string or hook may be attached so that the decorative element shown in FIG. 1 can be incorporated into other items or utilized as a hanging ornament, such as may be utilized on a Christmas tree, for mobiles, etc.

Figure 2:
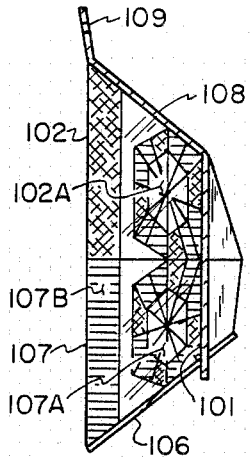
FIG. 2 is a cross-sectional view of a multidimensional decorative element in accordance with the present invention and taken along the section lines 2—2 of FIG. 1.
Figure 3:
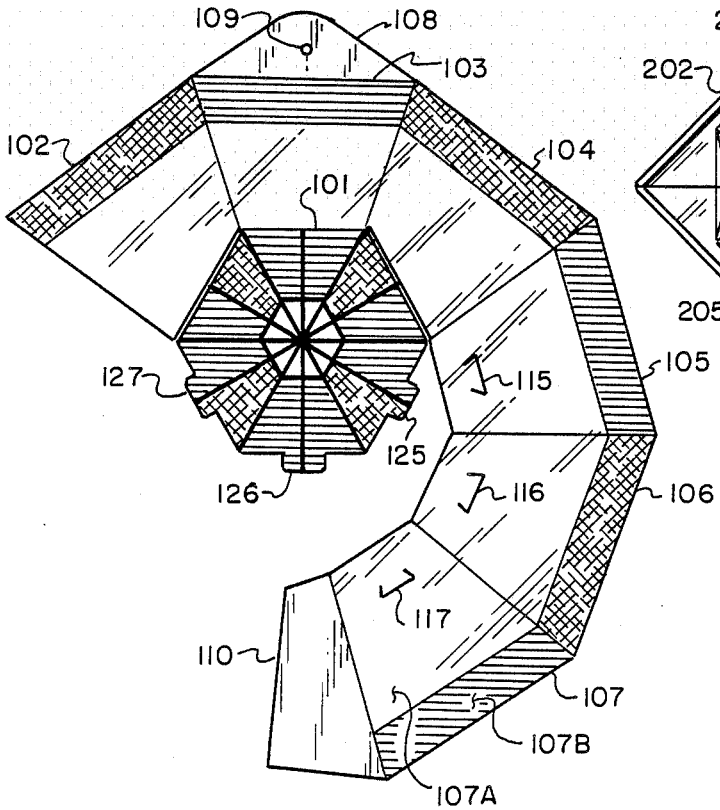
FIG. 3 is a front-view of a hexagonal multidimensional decorative element in accordance with the present invention as seen in FIG. 1 but in its unassembled form.

Referring now to FIG. 3, a multidimensional decorative element similar to that shown in FIG. 1 is shown in a flat or knocked-down form that may be employed for one-piece construction. All of the numerical indicia shown in FIG. 3 correspond to those shown in FIGS. 1 and 2 with the addition of certain other elements. As shown in FIG. 3, which is of flat material construction, the joinder of panels 102 and 103 with the base are scored for folding, while the joinder between panel 104 and the base is separated. Included on panel 101 are tabs 125, 126 and 127. These tabs, when the decorative element is assembled, engage slots 115, 116 and 117, respectively, while panel 110A, which is adjacent to panel 107 and which may include a pressure-sensitive adhesive, is adapted when the device is assembled to be placed behind panel 102. Thus, when assembled, the decorative element of FIG. 3 will closely approximate that shown in FIG. 1 and FIG. 2.

Other forms of construction for the decorative element of FIG. 1 can also be employed where the individual panels can be glued to each other if paper construction is used or joined by any other technique, depending upon the material used for the decorative element itself.

Figure 4:
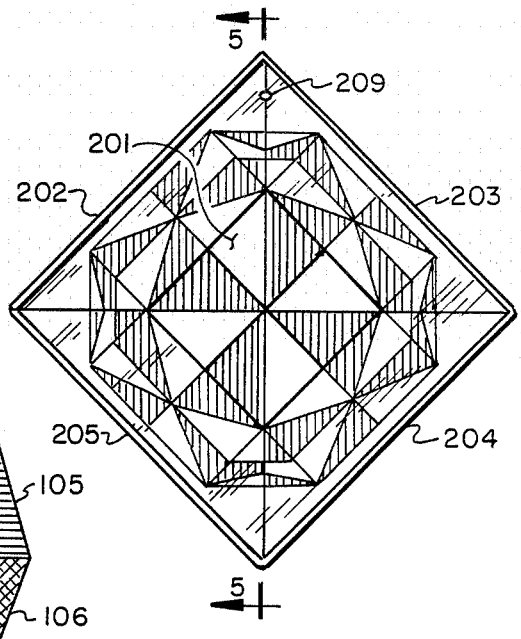
FIG. 4 is a front-view of a square version of a multidimensional decorative element in accordance with the present invention.

Referring now to FIG. 4, a multidimensional decorative element of square form in accordance with the present invention is shown. The construction employed is similar to that shown in the hexagonal element of FIG. 1. Referring now to FIG. 4, flat panel or base panel 201 is surrounded by four angularly inclined panels 202, 203, 204 and 205. Again, any or all of the surfaces may include a reflective coating as well as include decorative elements on any, all or none of the panels included. Again, as may be seen FIG. 4 and also in cross-sectional view shown in FIG. 5, assuming a graphic element is present actually only on the panel 201, the design thereof will be reflected on the panels 202 through 205 inclusive. Because of the angular relationship of panels 201 through 205, which can readily be seen by reference of a cross-section view of FIG. 5, the reflected design will be similar but different in perspective than that of the flat panel 201 as seen by any viewer. It should also be noted that as the viewer's eye passes the decorative element shown in FIG. 4, as well as that of FIG. 1, that the relative reflective images shown on the angularly placed side panels will change depending upon the angle of view.

Figure 5:
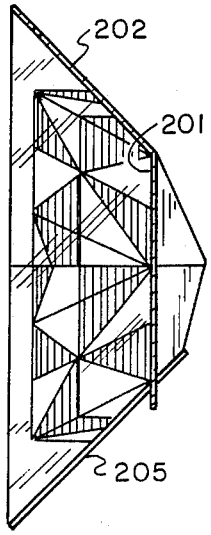
FIG. 5 is a cross-sectional view of a square multidimensional decorative element in accordance with the present invention and as shown in FIG. 4 and taken along section lines 5—5.
Figure 6:
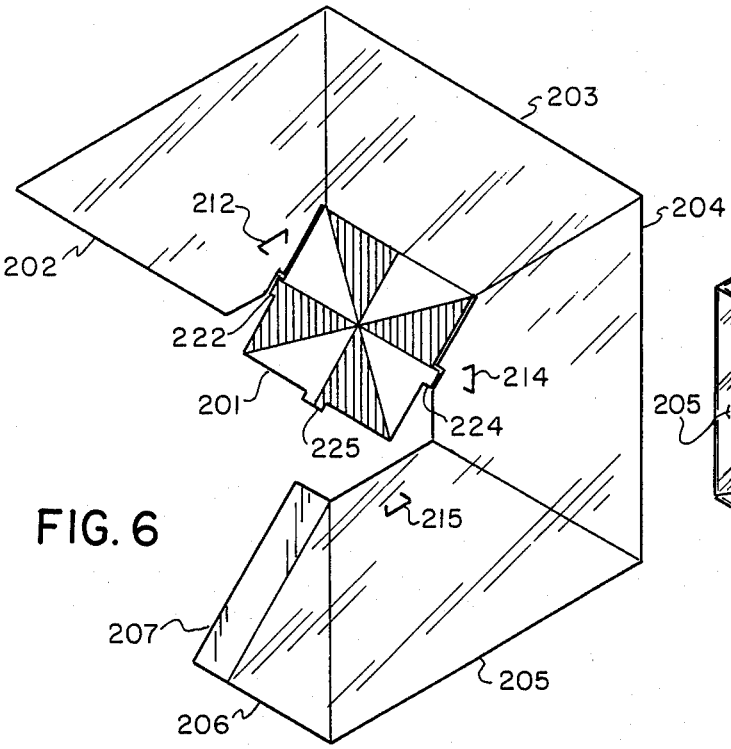
FIG. 6 is a front-view of a square multidimensional decorative element in accordance with the present invention and simialr to that shown in FIG. 4 but shown in the unassembled form.

Referring now to FIG. 6, the knocked-down or flat version of the decorative element of FIG. 4 is shown. The numerical indicia included in FIG. 6 are similar to those in FIGS. 4 and 5 with the addition of tabs 222, 224 and 225 which project from the planar base panel 201 and are adapted for engagement with slots 212, 214 and 215. Also included in the knocked-down version of the element as seen in FIG. 6 is panel 206, which may include a pressure-sensitive adhesive receiving section 207, both of which when the device is assembled are intened for placement behind panel 202 on which the adhesive would be located.

Figure 7:
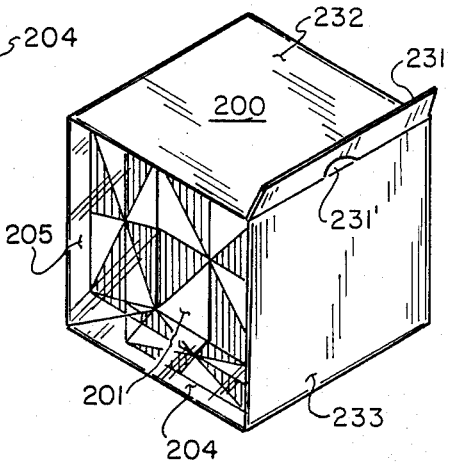
FIG. 7 is a perspective view of a multidimensional decorative element in accordance with the present invention of square form and shown incorporated into a box-like structure, but adapted however, to be used for ornamental purposes or as a decorative container.

Referring now to FIG. 7, a square multidimensional decorative element similar to that shown in FIGS. 4, 5 and 6 is shown incorporated into a box-like container 200 which includes side panels 232, 233 as well as side panels 234 and 235 (not seen) and a rear panel 283 (also not shown). At the juncture of panels 232 and 233, projecting tab 231 is shown which may be adapted for providing an opening therein 231′ through which a string, hook or other device may be inserted so that the complete element, including the boxlike structure surrounding it, can be utilized as a decorative device or ornament. In alternate construction, this tab or projection could be eliminated. The exterior surface of the box-like portion of the design may or may not include reflective surfaces, depending upon the desired effect chosen for the overall decorative element.

Figure 8:
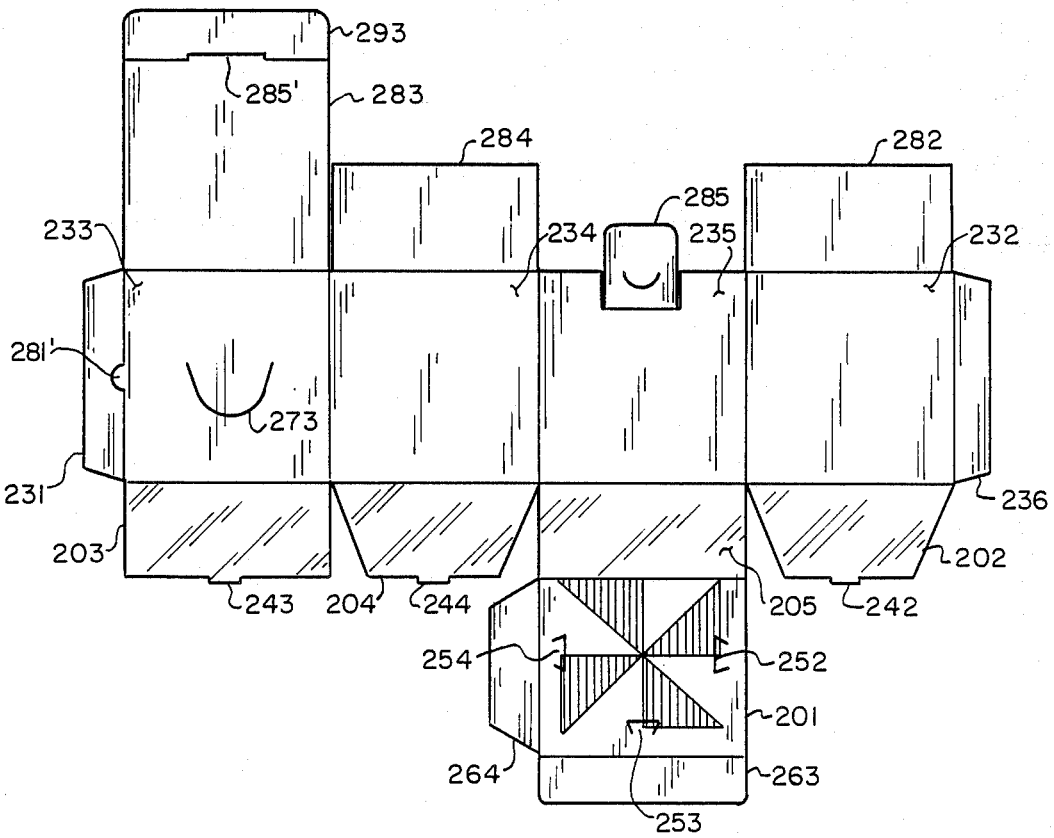
FIG. 8 is a front-view of a multidimensional decorative element in accordance with the present invention of square form and incorporated into a box-like structure similar to that shown in FIG. 7 but in the unassembled form.

A number of different forms of construction for the decorative element, and for the box-like container associated therewith can be utilized, such as glued tube, glued-bridge construction, etc. A form of one-piece or knocked-down construction is also anticipated which can be best understood by reference to FIG. 8. In FIG. 8, the basic box construction consists of folding between the panels 233, 234, 235 and 232 in such a manner that tab 236 may be affixed to projection 231 or, in the alternative, if no projection such as 231 is present, may be fastened to the inside of panel 233. At this point, the panels 263 and 264 will be folded downward, after which reflective side angular panel and the base panel 201 will be placed downward into the receiving portion of the box-like structure formed. After this, the three other angular side panels 202, 203 and 204 will also be bent downward in such a manner that the tabs 242, 243 and 244 thereon may be pressed into engagement with slots 252, 253 and 254, respectively. Panel 263 also will engage curved slot 273 in panel 233. In this manner, the assembled unit will resemble that shown in FIG. 7, except the rear portion opposite the decorative element portion will still be open. This may be closed in any wellknown manner, however, as shown in FIG. 8, the panels 284 and 282 will be folded down, after which panel 283 will fold down over them with extending tab 293 being placed inside of sidewall 235. Extending tab 285 will then be brought over and folded over to engage with slot 285′ to lock the rear closure of the completed element.

Figure 9:
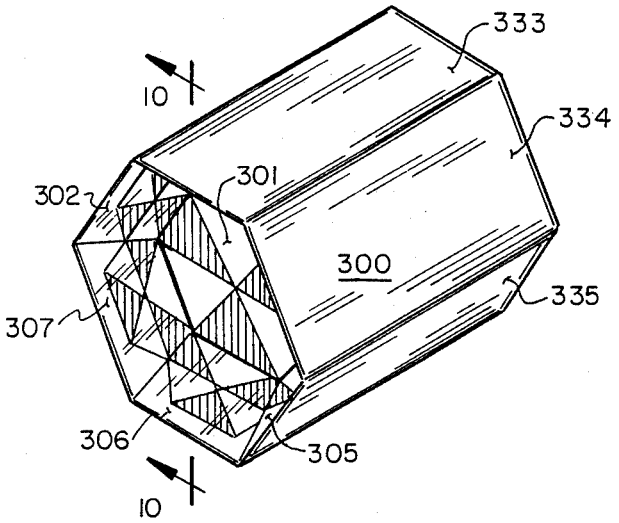
FIG. 9 is a perspective view of a multidimensional decorative element of hexagonal form incorporated into a hexagonal box or container which may be useful for packaging items or as a decorative element.

Referring now to FIG. 9, a multidimensional decorative element similar to that shown in FIGS. 1, 2 and 3, is shown incorporated into a hexagonal container box 300 in a manner similar to that in which the decorative element shown in FIGS. 4, 5 and 6 was incorporated into container 200 of FIG. 7.

Figure 10:
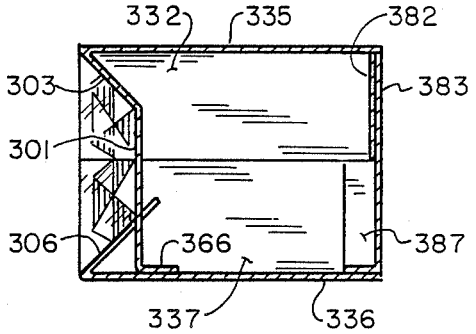
FIG. 10 is a cross-sectional veiw of a multidimensional decorative element similar to that shown in FIG. 9 and taken along the sectional lines 10—10 of FIG. 9.

In the design shown in FIG. 9, the reflective panel 301 with a graphic design included thereon is surrounded by six reflective panels, 302, 305, 306 and 307 (and 303 and 304 not shown). Because the reflective surface of the side panels which are angularly displaced from the base panel 301, a distorted or changed view of the graphic design included on panel 301 is seen by a viewer with the particular angle of view determining the effect observed by the viewer. The hexagonal container includes six side walls 333, 334 and 335, as well as 332, 336 and 337 (not seen). The details of construction are further understood by reference to FIG. 10 which is a cross-sectional view of the element of FIG. 9 taken along section lines 10—10.

Figure 11:
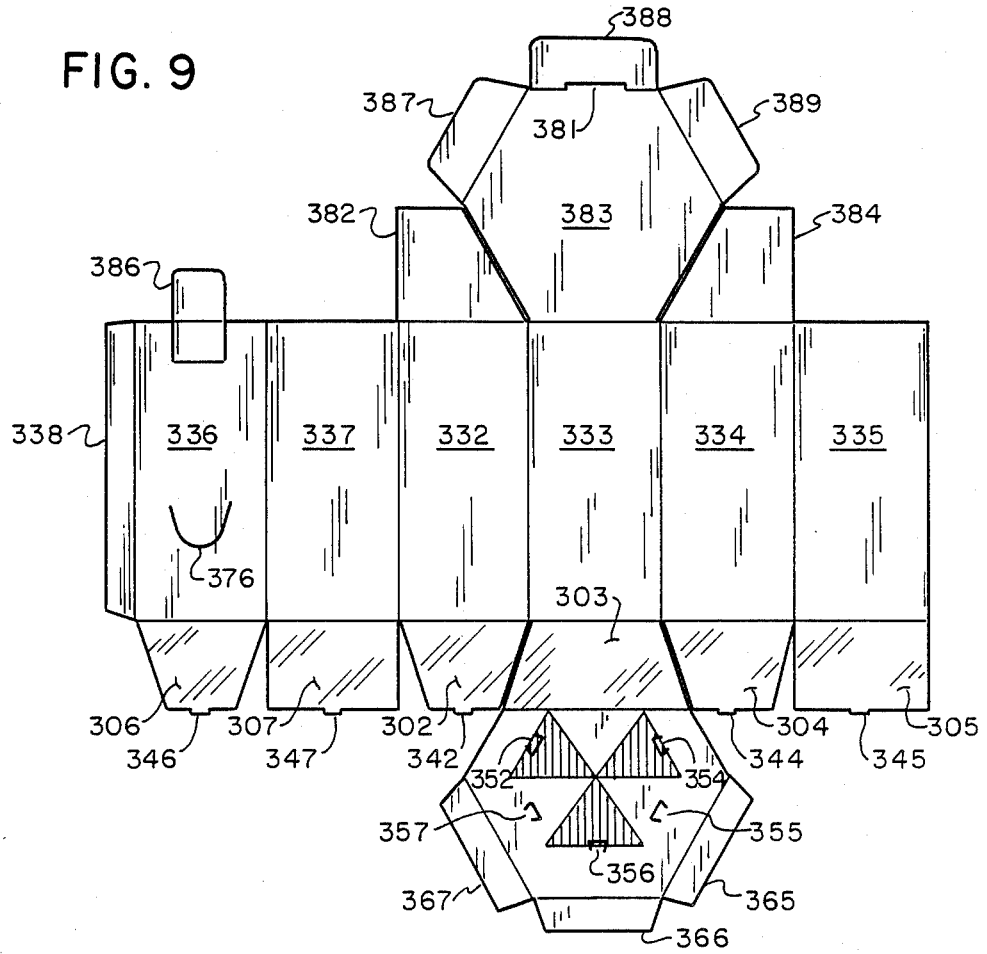
FIG. 11 is a front-view of a multidimensional decorative element like that shown in FIG. 9 but shown in its unassembled form.

Referring now to FIG. 11, the format for one-piece construction of the element shown in FIG. 9 is shown. Assembly of the flat panel shown in FIG. 11 into the element of FIG. 9 is accomplished by folding the side panels 332, 333, 334, 335, 336 and 337 along the lines between each panel and joining tab 338 to the rear of panel 335. After this, the angular panel 303 affixed to flat panel 301 is depressed into the area formed by the six side walls with the extensions 365, 366 and 367 thereof folded downward first. Extension 366 also engages curved slot 376 included in side wall 336. After this operation is complete, other angular side panels 302, 304, 305, 306 and 307 will also be pressed downward with the tabs 344, 345, 346 and 347 arranged to engage with tab receiving slots 352, 354, 355, 356 and 357.

The other end of the container could also be adapted to include a decorative element like that seen in FIG. 9, but in the present, consists only of a flat closure, wherein tabs 382, 384 are first folded down after which the tabs that are 387, 388 and 389, which are extensions of bottom portion 383, will also be folded down with the entire assembly of panel 383 being folded down and the slot 381 being adapted to engage tab 386 which extends from side panel 336 to lock the bottom closure in place.

As noted previously, different three-dimensional reflective visual images can be achieved by varying the angle of degree of the side panels in relationship to the flat base panel.

While not specifically shown, it will be readily apparent to those skilled in the art how it would be possible to incorporate a number of elements like those shown in FIGS. 1 and 4 into a flat panel which may be utilized for decorative purposes, such as inclusion in box tops, decorative panels, etc. Such designs could readily be used for identification purposes as a logo or similar device.

It will become apparent from the foregoing disclosure that a number of modifications to the present invention can be made without departing from the spirit of the invention which shall be limited only be the scope of the claims appended hereto.

What is claimed is:

1. A multidimensional decorative element comprising:

a first planar base panel, including;

at least three sides and a first surface;

a plurality of planar side panels, each extending angularly away from the plane of said base panel and each of said side panels including a first surface and a first side adjacent to a different one of said base panel sides;

at least one of said panel first surfaces being light reflective;

each of said side panels further including a pair of second sides, each of one of said pair of second sides positioned adjacent to a second side on a different one of said side panels;

at least one of said panel first surfaces being graphically decorated;

said light reflective surface and said graphically decorative surface being combined to produce a visual three-dimensional visual effect.

2. A multidimensional decorative element as claimed in claim 1, wherein:

said first planar base panel comprises a geometric form.

3. A multidimensional decorative element as claimed in claim 2, wherein:

said geometric form is that of a triangle.

4. A multidimensional decorative element as claimed in claim 2, wherein:

said geometric form is that of a square.

5. A multidimensional decorative element as claimed in claim 2, wherein:

said geometric form is that of a hexagon.

6. A multidimensional decorative element as claimed in claim 2, wherein:

said geometric form is that of an octagon.

7. A multidimensional decorative element as claimed in claim 1, wherein:

said base panel first surface is light reflective.

8. A multidimensional decorative element as claimed in claim 1, wherein:

at least one of said side panel first surfaces is light reflective.

9. A multidimensional decorative element as claimed in claim 1, wherein:

said base panel first surface and said side panel first surfaces are light reflective.

10. A multidimensional decorative element as claimed in claim 9, wherein:

said light reflective base panel first surface and said side panel first surfaces are metalized.

11. A multidimensional decorative element as claimed in claim 10, wherein:

said metalized light reflective surfaces are constructed of metalized polyester.

12. A multidimensional decorative element as claimed in claim 1, wherein:

said base panel first surface includes graphic decoration.

13. A multidimensional decorative element as claimed in claim 1, wherein:

at least one of said side panel first surfaces is graphically decorated.

14. A multidimensional decorative element as claimed in claim 1, wherein:

said base panel first surface and at least one of said side panel first surfaces includes graphic decoration.

15. A multidimensional decorative element as claimed in claim 1, wherein:

said base panel first surface is light reflective and includes graphic decoration.

16. A multidimensional decorative element as claimed in claim 1, wherein:

at least one of said side panel first surfaces is light reflective and includes graphic decoration.

17. A multidimensional decorative element as claimed in claim 1, wherein:

said base panel first surface and said side panel first surfaces are light reflective and each of said surfaces further include graphic decoration.

18. A multidimensional decorative element as claimed in claim 1, wherein:

said panels are constructed of a flexible resillient sheet material cut, scored and foldable to provide the necessary relationship to each other.

19. A multidimensional decorative element as claimed in claim 18, wherein:

said resillient sheet material is paperboard.

20. A multidimensional decorative element as claimed in claim 18, wherein:

said flexible resillient sheet material is plastic.

21. A multidimensional decorative element as claimed in claim 18, wherein:

said resillient sheet material includes at least one light reflective surface.

22. A multidimensional decorative element as claimed in claim 18, wherein:

said flexible resillient sheet material is metallic.

23. A multidimensional decorative element as claimed in claim 1, wherein:

said element is of one-piece construction.

24. A multidimensional decorative element as claimed in claim 23, wherein:

said first planar base panel includes at least one tablike projection extending from one of the sides associated therewith and at least one of said side panels includes a slot therein adapted to receive said tablike projection.

25. A multidimensional decorative element as claimed in claim 23, wherein:

said side panels are retained in the proper angular relationship to said base panel by means of gluing.

26. A multidimensional decorative element as claimed in claim 1, wherein:

said element is integrated with a container adapted package or stores items therein.

27. A multidimensional decorative element as claimed in claim 1, wherein:

said element is integrated into a flat panel.

28. A multidimensional decorative element as claimed in claim 1, wherein:

the angles at which said plurality of planar side panels each extend away from the plane of said base panel are all equal.

29. A multidimensional decorative element as claimed in claim 1, wherein:

at least one of said plurality of planar side panels extends angularly away from the plane of said base panel at an angle different from that of at least one other one of said plurality of planar side panels.

30. A multidimensional decorative element as claimed in claim 16, wherein:

said reflective surface and said graphically decorated surface combine to produce a three-dimensional visual effect.

31. A multidimensional decorative element as claimed in claim 17, wherein:

said light reflective surfaces and said graphically decorated surfaces combine to produce a visual three-dimensional effect.

32. A multidimensional decorative element as claimed in claim 1, wherein:

there is further included suspension means connected to said element, whereby said element functions as a decorative ornament.

33. A multidimensional decorative element as claimed in claim 1, wherein:

said decorative element and a plurality of elements of similar construction are combined to form a decorative panel.

34. A multidimensional decorative element as claimed in claim 1, wherein:

each one of said pair of said are provided to abut with said second side on said different one of said side panels.

* * * * *